US011261060B2

(12) United States Patent
Woodhams

(10) Patent No.: US 11,261,060 B2
(45) Date of Patent: Mar. 1, 2022

(54) STAIRLIFTS

(71) Applicant: Stannah Stairlifts Limited, Hampshire (GB)

(72) Inventor: Max Daniel Woodhams, Hampshire (GB)

(73) Assignee: Stannah Stairlifts Limited, Hampshire (GB)

( * ) Notice: Subject to any disclaimer, the term of this patent is extended or adjusted under 35 U.S.C. 154(b) by 127 days.

(21) Appl. No.: 16/635,707

(22) PCT Filed: Jul. 30, 2018

(86) PCT No.: PCT/GB2018/052171

§ 371 (c)(1),
(2) Date: Jan. 31, 2020

(87) PCT Pub. No.: WO2019/025778

PCT Pub. Date: Jul. 2, 2019

(65) Prior Publication Data

US 2021/0130133 A1 May 6, 2021

(30) Foreign Application Priority Data

Jul. 31, 2017 (GB) ..... 1712285

(51) Int. Cl.
*B66B 9/08* (2006.01)

(52) U.S. Cl.
CPC ..... *B66B 9/0815* (2013.01); *B66B 9/0838* (2013.01); *B66B 9/0846* (2013.01)

(58) Field of Classification Search
CPC .... B66B 9/0815; B66B 9/0838; B66B 9/0846
See application file for complete search history.

(56) References Cited

U.S. PATENT DOCUMENTS

| | | | | |
|---|---|---|---|---|
| 5,720,364 | A * | 2/1998 | Glover | B66B 9/0838 187/201 |
| 7,051,841 | B1 * | 5/2006 | Kasbergen | B66B 9/0838 187/201 |
| 8,607,936 | B2 * | 12/2013 | Szentistvany | B66B 9/0807 187/201 |
| 2005/0279580 | A1 * | 12/2005 | Szentistvany | B66B 9/0838 187/201 |
| 2008/0035430 | A1 * | 2/2008 | Van Der Heiden | B66B 9/0838 187/201 |
| 2008/0128213 | A1 * | 6/2008 | Harris | B66B 9/08 187/201 |

(Continued)

FOREIGN PATENT DOCUMENTS

| | | | |
|---|---|---|---|
| EP | 0560433 | A1 | 9/1993 |
| EP | 0738232 | A1 | 10/1996 |

(Continued)

*Primary Examiner* — Michael A Riegelman
(74) *Attorney, Agent, or Firm* — Dinsmore & Shohl LLP

(57) ABSTRACT

A mechanically-based arrangement for locking a stairlift chair relative to a stairlift carriage in the event of a failure within the drive that is provided to maintain the chair level as the stairlift is in operation. The arrangement uses inter-engaging components that are engaged and dis-engaged in timed relationship to rotation of the levelling motor. At all times at least one set of inter-engaging components are engaged.

5 Claims, 3 Drawing Sheets

(56) References Cited

U.S. PATENT DOCUMENTS

| | | | | |
|---|---|---|---|---|
| 2010/0274409 | A1* | 10/2010 | Smith | B66B 9/0838<br>700/304 |
| 2010/0314201 | A1* | 12/2010 | Stannah | B66B 9/0853<br>187/201 |
| 2011/0088977 | A1* | 4/2011 | Woodhams | B66B 9/0853<br>187/201 |
| 2014/0060976 | A1* | 3/2014 | Szentistvany | B66B 9/08<br>187/202 |
| 2014/0151157 | A1* | 6/2014 | Hall | B66B 9/0807<br>187/202 |
| 2014/0299416 | A1* | 10/2014 | Jakes | B66B 9/0838<br>187/201 |
| 2017/0158464 | A1* | 6/2017 | De Kroon | B66B 9/0838 |
| 2018/0044133 | A1* | 2/2018 | Cook | B66B 1/30 |
| 2018/0072537 | A1* | 3/2018 | Pugh | B66B 9/0807 |
| 2021/0130133 | A1* | 5/2021 | Woodhams | B66B 9/0838 |

FOREIGN PATENT DOCUMENTS

| | | | |
|---|---|---|---|
| GB | 2484709 | A | 4/2012 |
| WO | 1995/18763 | A1 | 7/1995 |
| WO | 2004/014773 | A1 | 2/2004 |
| WO | 2006/001694 | A2 | 1/2006 |
| WO | 2008/142372 | A1 | 11/2008 |
| WO | 2012/120286 | A2 | 9/2012 |
| WO | 2016/170038 | A1 | 10/2016 |

* cited by examiner

STAIRLIFTS

REFERENCE TO RELATED APPLICATIONS

This application is a U.S. national stage application of PCT/GB2018/052171, filed Jul. 30, 2018, which claims priority to Great Britain application No. GB1712285.4, filed Jul. 31, 2017, the entire content of both of which is incorporated herein by reference.

FIELD OF THE INVENTION

This invention relates to stairlifts and, in particular, to the safety system of a stairlift.

BACKGROUND OF THE INVENTION

In a curved stairlift installation the angle of the stairlift rail varies with respect to a horizontal plane. As the stairlift carriage moves over a transition bend (a bend in a vertical plane), the chair mounted on that carriage must be kept level. In the embodiment of stairlift described in our European Patent No. 0 738 232 the chair is pivotally mounted on the carriage and a chair levelling motor operates to keep the chair level as the angle of the rail, and thus the orientation of the carriage, varies.

An arrangement of the type shown in EP 0 738 232 gives rise to a concern that, in the event of failure of the chair levelling mechanism, the chair could rotate in an uncontrolled manner relative to the carriage. Obviously, in the event of such a failure, a person seated in the chair could be injured. Mindful of the possibility of such failures, EP 0 738 232 also describes the use of a back-up safety arrangement in which a pair of mercury switches trigger the release of a locking pin when the chair angle reaches a predetermined off-level upper limit on either side of a central, level, position. The locking pin, in turn, extends into a locating aperture in the chair interface so as to lock the position of the chair relative to the carriage. The locking mechanism also triggers the main safety circuit which cuts power to the stairlift drive motor and brings the carriage to a halt.

Since the filing of EP 0 738 278 it has become commonplace to substitute a single analogue tilt sensor for the mercury switches however, in common with the mercury switches, a tilt sensor only gives an output signal when the off-level limit is reached.

This off-level limit is typically 5° however, because the chair may have built up momentum before the failure is detected, the locking mechanism triggered, and the locking mechanism engages, the applicable standards prescribe that that chair must be brought to a halt within 15° of vertical.

This problem is addressed in our International Patent Application WO2008/142372. This patent application describes an arrangement in which movement of the levelling drive, and rotational movement of the chair are separately monitored using encoders. In the event that the encoder readings vary, a spring-loaded pin is released by a solenoid to engage in a slot formed in an indexing ring attached to the chair. The indexing ring is provided with a series of slots with the intention that, should the locking pin be released, it will engage in that slot which, when the pin is released, is located closest to the pin.

Whilst this solution offers significant improvements over that which preceded it, it still presents the following issues:

1. Response time in the event of failure is critical. Any failure of the levelling system must be detected, and the locking pin released and engaged in a slot in the indexing ring, within 15° of movement of the chair from the vertical. This has proved difficult to achieve on a consistent basis.
2. The slow response time has, in some instances, been due to backlash inaccuracies in one or both of the encoders, which inaccuracies are exacerbated by wear.
3. When released by the solenoid, the locking pin can skip the closest slot in the indexing ring and only engage in the second or third available slot. This makes the response time very unpredictable. More slots could be added to address this problem but, for a given diameter of indexing ring, this would then necessitate reducing the widths of the slots and diameter of the locking pin. The consequence of this would be to leave the locking pin susceptible to Failure when subjected to the significant shock loads imposed when arresting the rotating chair. Similarly, adding slots to the indexing ring would reduce the material between adjacent slots, thus weakening the ring itself. In compact arrangements such as a stairlift carriage, significantly increasing the diameter of the indexing ring is not an option.
4. There is a preference, in the stairlift field, for safety devices which are mechanically based rather than electrical/electronic based.

It is an object of the invention to provide a safety method and apparatus for a stairlift and/or a stairlift having a safety facility which will go at least some way in addressing the aforementioned problems; or which will at least provide a novel and useful choice.

SUMMARY OF THE INVENTION

Accordingly the invention provides a stairlift having a carriage moveable along a rail; a chair pivotally mounted on said carriage; a levelling motor operable to pivot said chair relative to said carriage; and a safety facility configured and operable to lock said chair relative to said carriage in the event of a drive failure between said levelling motor and said chair, said stairlift being characterised in that said safety facility includes a plurality of inter-engaging components constrained to engage and dis-engage in timed relationship to rotation of said levelling motor, there being some engagement of said inter-engaging components at all times.

Preferably said inter-engaging components comprise a plurality of pins on the one hand, and a plurality of slots on the other hand.

Preferably said stairlift further includes a gearbox driven from a motor output shaft of said levelling motor and having a gearbox output shaft connected to said chair, said pins being displaced into said slots by one or more earn members rotating in timed relationship with said motor output shaft.

Preferably said one or more cam members are mounted on, and rotate with, said motor output shaft.

Preferably said slots are arranged at a constant radius about an axis of said gearbox output shaft.

Many variations in the way the present invention can be performed will present themselves to those skilled in the art. The description which follows is intended as an illustration only of one means of performing the invention and the lack of description of variants or equivalents should not be regarded as limiting. Subject the falling within the scope of the appended claims wherever possible, a description of a specific element should be deemed to include any and all equivalents thereof whether in existence now or in the future.

BRIEF DESCRIPTION OF THE DRAWINGS

One form of the invention will now be described with reference to the accompanying drawings in which.

DETAILED DESCRIPTION OF THE INVENTION

Figure 1:
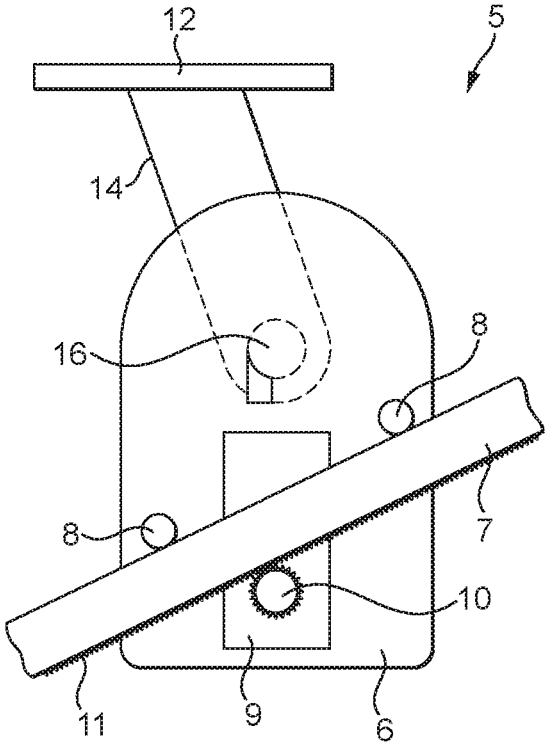
FIG. 1: shows a schematic rear view of a stairlift which may incorporate a safety facility according to the invention.

Referring to FIG. 1, the invention provides a stairlift 5 which includes a carriage 6 supported on a rail 7 by rollers 8. Mounted within the carriage 6 is a main drive motor/gearbox 9 having a drive pinion 10 mounted on the output thereof. The drive pinion 10 engages a rack 11 so that as the drive motor rotates, the carriage 6 is driven along the rail 7.

Figure 2:
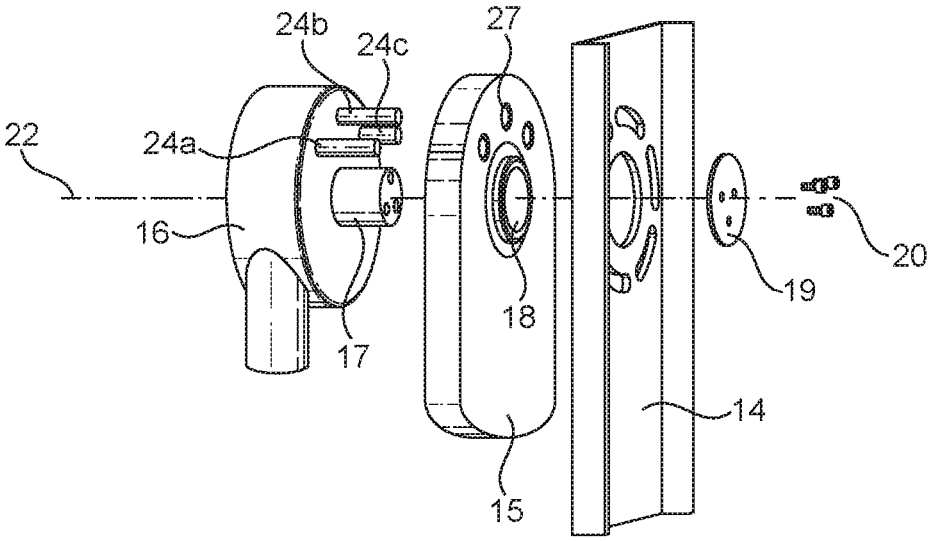
FIG. 2: shows an exploded view of a number of components that combine to provide a stairlift having a safety facility according to the invention.

A chair 12 is mounted on the carriage 6 so that the chair can pivot relative to the carriage 6. As shown the chair is mounted on a chair interface 14 which is directly and pivotally connected to part 15 (FIG. 2) being part of the chassis of carriage 6.

The pivotal movement of the chair 12 relative to the carriage 6 is effected by a motor and gearbox 16, having an output shaft 17, the shaft 17 passing through aperture 18 in the carriage part 15 and being fixed to the interface 14 by fixing plate 19 and fixing bolts 20. This arrangement ensures that the output shaft 17 is not subjected to vertical loads applied through the chair 12 and/or interface 14.

In our European Patent (EP) 0 738 232 we describe a method of controlling the operation of the motor 15 to ensure that the chair is maintained level as the angle of the rail 7 varies relative to a horizontal plane, however other forms of levelling are also possible and the present invention is not limited in application to the levelling arrangement described in EP 0 738 232.

In accordance with the invention, the motor/gearbox unit 16 and the interface 14 are provided with inter-engaging components that selectively engage and dis-engage to limit the degree of rotation of the chair 12 relative to the carriage should there be a failure within the levelling system, but which do not interfere with the levelling action during normal operation. In the form shown, the inter-engaging components comprise a plurality of pins 24*a*, 24*b*, 24*c* projecting from the motor/gearbox unit 16, and a plurality of slots 25*a*, 25*b*, 25*c*, 25*d*, 25*e* & 25*f* provided in the interface 14. The pins 24 and slots 25 are preferably (though not necessarily) arranged at the same distance from axis 22 and are respectively circumferentially spaced. The pins 24, which can project from the unit 16 to a variable degree pass through, and are supported by, apertures 27 in the chassis plate 15 and, depending on the position of the interface 14 relative to the carriage and the extent of projection of the pins 24, the pins 24 can engage in the slots 25.

Figure 3:
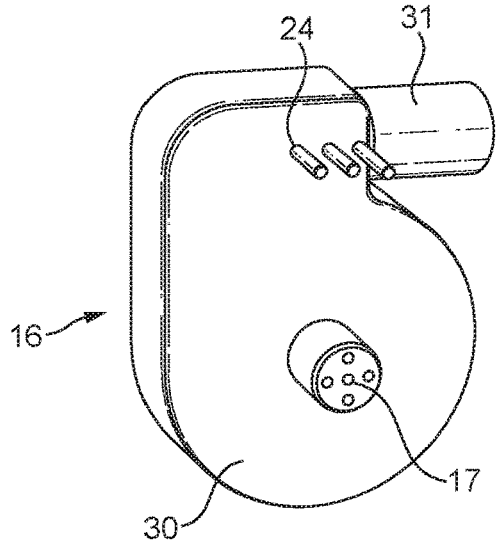
FIG. 3: shows a motor/gearbox assembly incorporating a safety facility according to the invention.
Figure 4:
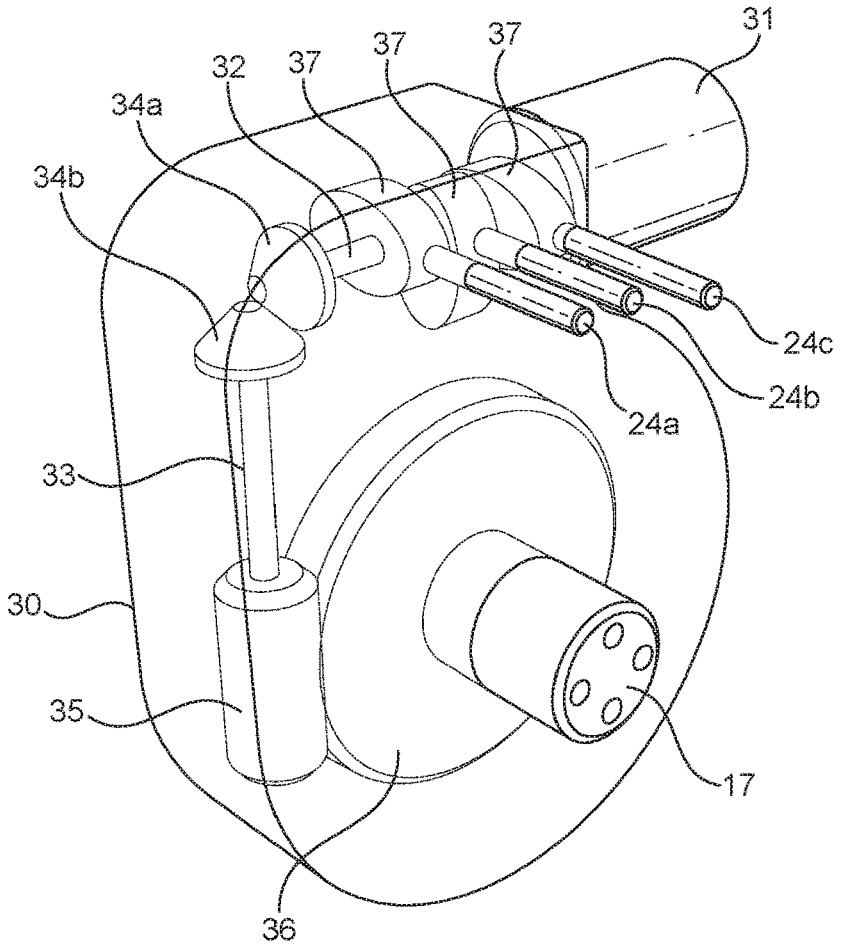
FIG. 4: shows an isometric view of the operative parts of the assembly shown in FIG. 3.

A suitable control facility is provided to control the projections of the pins 24 in timed relationship to output of the chair levelling motor. Referring now to FIGS. 3 & 4, motor/gearbox unit 16 includes a housing 30 on the exterior of which is mounted a chair levelling motor 31 and inside of which are components forming a gearbox. In the particular form shown the motor output shaft 32 drives gearbox input shaft 33 through bevel gears 34*a*, 34*b*. Mounted on the gearbox input shaft 33 is a worm gear 35 which drives for rotation therewith. So far then the motor/gearbox unit 16 is entirely conventional however, as can be seen, one or more cams 37 are mounted on the motor output shaft 32 for rotation therewith, each earn serving to displace one of the pins 24. Springs (not shown) may be provided to maintain the pins in contact with their respective cam.

FIGS. 5A-5G show a sequence of chair positions relative to the carriage, advancing in about 5° increments, to illustrate the operation of the invention. In this sequence the chair interface 14 is moving in a counter-clockwise relative to the carriage 6 or the carriage 6 can be viewed as moving clockwise relative to the interface.

Figure 5:
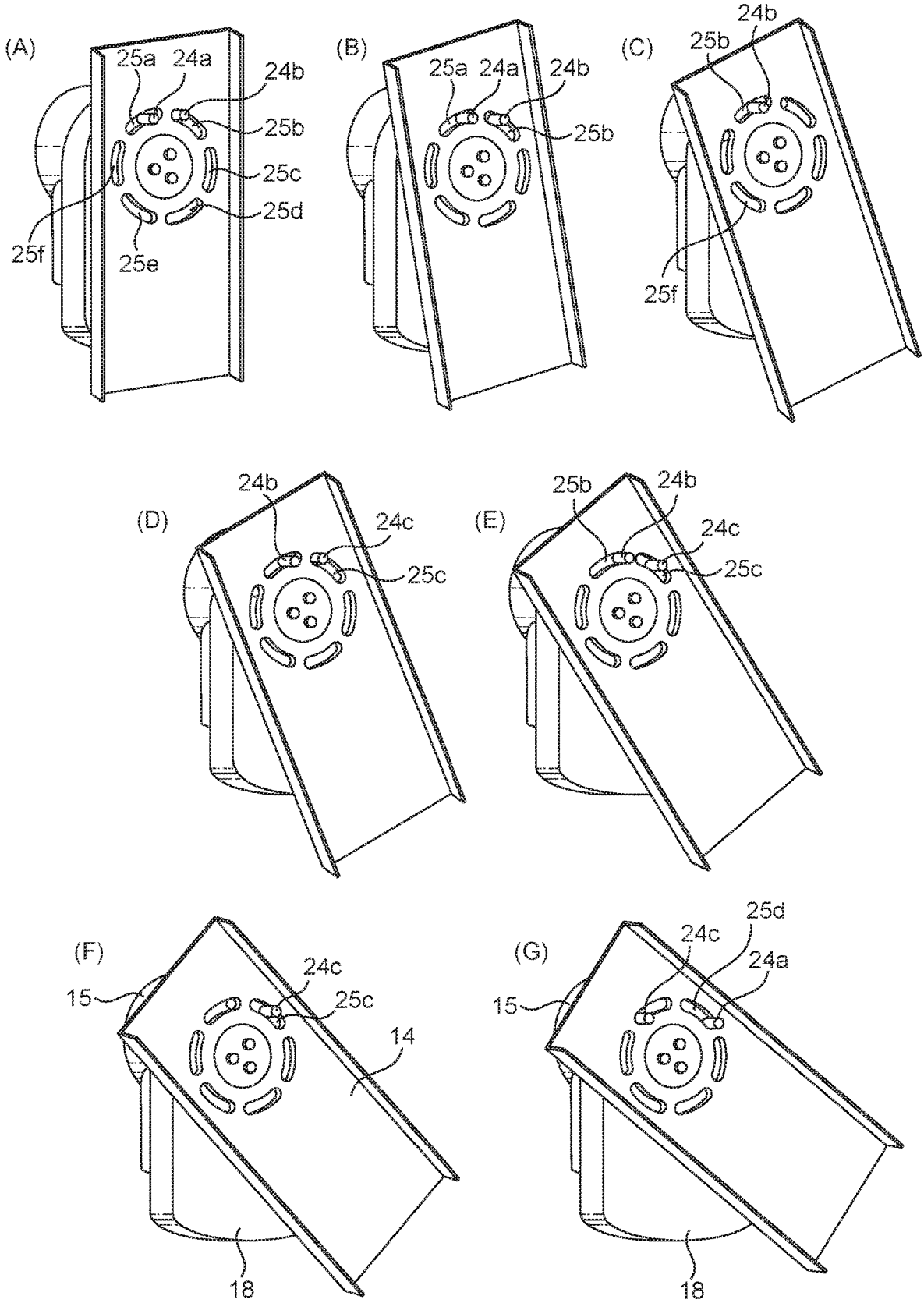
FIGS. 5A-5G: show the components of FIG. 2 assembled and in successive relative positions.

In FIG. 5A pin 24*a* is projected out by the cam surface to engage through slot 25*a* in the interface, and pin 24*b* is projected out to engage slot 25*b*. Pin 24*c* is retracted. As the chair moves in a counter-clockwise direction relative to the carriage the slots are displaced relative to pins 24*a* & 24*b* as shown in FIG. 5B. In FIG. 5C the pin 24*b* remains engaged in slot 25*b* but pin 24*a* is retracted out of engagement with slot 25*a*. In FIG. 5D and in FIG. 5E pins 24*b* and 24*e* are in full engagement with slots 25*b* and 25*c* while pin 24*a* is retracted. In FIG. 5F the pin 24*b* is also retracted leaving pin 24*c* engaged in slot 24*c* while in FIG. 5G the pin 24*c* remains engaged in slot 25*c* while the pin 24*a* is again projected to engage slot 25*d*.

It will be appreciated that, as at least one pin 24 is engaged in one slot 25 at all times, in the event of mechanical failure in the levelling drive, the maximum uncontrolled movement of the chair relative to the carriage is limited to the available movement of the slot over the engaged pin. By increasing the number of pins and slots, this movement can be kept to a minimum, the limiting factor being space to provide further slots and of the shear strength of the pins.

Arrangements other than that described above will present themselves to those skilled in the art. For example, rotation of the gearbox could be sensed electronically and electro-mechanical arrangements used to project the pins 24.

The invention claimed is:

1. A stairlift having a carriage moveable along a rail, the stairlift comprising:

a chair pivotally mounted on said carriage;

a levelling motor operable to pivot said chair relative to said carriage; and a safety facility configured and operable to lock said chair relative to said carriage in the event of a failure between said levelling motor and said chair, said safety facility comprising a plurality of inter-engaging components constrained to engage and dis-engage between said levelling motor and said chair, at least one of said inter-engaging component engages when at least one of said inter-engaging component disengages.

2. The stairlift as claimed in claim 1 wherein said inter-engaging components comprise a plurality of pins, and a plurality of slots.

3. The stairlift as claimed in claim 2, further including a gearbox driven from a motor output shaft of said levelling motor and having a gearbox output shaft connected to said chair, said pins being displaced into said slots by one or more cam members rotating in timed relationship with said motor output shaft.

4. The stairlift as claimed in claim 3 wherein said one or more cam members are mounted on, and rotate with, said gearbox output shaft.

5. The stairlift as claimed in claim 3 wherein said slots are arranged at a constant radius about an axis of said gearbox output shaft.

* * * * *